US005847631A

United States Patent [19]

Taylor et al.

[11] Patent Number: 5,847,631

[45] Date of Patent: Dec. 8, 1998

[54] MAGNETIC RELAY SYSTEM AND METHOD CAPABLE OF MICROFABRICATION PRODUCTION

[75] Inventors: William P. Taylor, Smyrna; Mark G. Allen, Atlanta, both of Ga.

[73] Assignee: Georgia Tech Research Corporation, Atlanta, Ga.

[21] Appl. No.: 723,300

[22] Filed: Sep. 30, 1996

Related U.S. Application Data

[60] Provisional application No. 60/005,234, filed Oct. 10, 1995 and provisional application No. 60/015,422, filed Apr. 12, 1996.

[51] Int. Cl.[6] ..... H01H 51/22

[52] U.S. Cl. ..... 335/78; 257/415; 437/182; 437/228; 29/622

[58] Field of Search ..... 335/78–86, 128; 257/415, 419, 420, 532, 622; 437/225, 228, 515, 182; 200/83 N, 83 V; 156/653.7, 659.1; 29/622

[56] References Cited

U.S. PATENT DOCUMENTS

| | | | |
|---|---|---|---|
| 5,051,643 | 9/1991 | Dworsky et al. | 310/309 |
| 5,070,317 | 12/1991 | Bhagat | 336/200 |
| 5,374,792 | 12/1994 | Ghezzo et al. | 200/16 B |
| 5,398,011 | 3/1995 | Kimura et al. | 335/79 |
| 5,454,904 | 10/1995 | Ghezzo et al. | 216/13 |
| 5,462,839 | 10/1995 | de Rooif et al. | 430/320 |
| 5,475,353 | 12/1995 | Roshen et al. | 335/78 |
| 5,479,042 | 12/1995 | James et al. | 257/415 |
| 5,550,090 | 8/1996 | Ristic et al. | 437/228 |

OTHER PUBLICATIONS

Authors: William P. Taylor and Mark G. Allen Title: An Integrated Electromagnet for use as a Microrelay Driving Element; Published: Feb. 1994.

Authors: William P. Taylor and Mark G. Allen Title: Design and Methodology for the Fabrication of an Integrated Electromagnet for Use as a Microrelay Driving Element; Published: Apr. 1995.

*Primary Examiner*—Lincoln Donovan

*Attorney, Agent, or Firm*—Thomas, Kayden, Horstemeyer & Risley, L.L.P.

[57] ABSTRACT

A magnetic relay system is implemented to act as a relay driven by a magnetic flux yet capable of production through micromachining. The magnetic relay system has an electromagnet, a movable plate, and conductive contacts. The contacts are connected to the circuits of outside electrical systems that are to be controlled by the switching of the relay system. The plate is movable allowing it to engage both contacts and allow current flow between the contacts or to disengage both contacts and prevent current flow between the contacts. The electromagnet provides a sufficient magnetic flux at desired times to move the movable plate and thereby controls whether the movable plate is engaged with the contacts. The electromagnet, movable plate, and the conductive contacts may be formed on a substrate capable of construction using microfabrication techniques.

38 Claims, 9 Drawing Sheets

(SIDE VIEW)

(TOP VIEW)

(TOP VIEW)

(SIDE VIEW)

MAGNETIC RELAY SYSTEM AND METHOD CAPABLE OF MICROFABRICATION PRODUCTION

REFERENCE TO PRIOR APPLICATIONS

This application is based on and claims priority to Provisional Application Serial Numbers 60/005,234, filed Oct. 10, 1995 and 60/015,422, filed Apr. 12, 1996.

FIELD OF THE INVENTION

The present invention generally relates to electrical relays utilizing magnetic forces to control the relay's switching features, and, more particularly, to a micromachine magnetic relay system and method capable of production via micromachining or microfabrication techniques.

BACKGROUND OF THE INVENTION

A relay is a device which utilizes the variation of current in an electrical circuit to control the operation of another circuit. For example, a relay may cause current to flow in one circuit when the variation in current of another circuit reaches a certain predetermined point. The use of relays is widely known in the industry, and relays have been used in many applications such as data acquisition boards, telecommunications, security systems, automotive control circuitry, aircraft control circuitry and consumer products.

The development of micromachined relays is desirable because microfabrication techniques allow the construction of small, low profile relays capable of batch fabrication. Batch fabrication of relays can be used to produce a large number of relays at a cost not much greater than the cost of serially producing a small number of relays. As a result, the productive efficiency of relays is maximized. In addition, microfabrication of relays facilitates the construction of larger arrays of relays. The advantages of micromachined devices are widely known in the industry, and one of ordinary skill in the art can appreciate the usefulness of a micromachined relay.

Micromachined relays using electrostatic actuation have been realized in the art. Electrostatic actuation means that non-magnetic forces are used to control the switching features of the relay. However, electrostatic actuation generally requires high voltages or results in high contact resistance and low carry current, and these characteristics limit the relay's use in many applications. Although the current requirements are usually higher, magnetically-driven relays require relatively low voltage making these devices attractive in many applications.

Micromachined relays using magnetic actuation have already been successfully implemented in the industry to some degree. These devices have shown that the switching speeds for micromachined magnetically-driven relays are generally faster than previous electromechanical relays. However, these previous micromachined magnetically-driven relays utilize a magnetic flux supplied by an external electromagnet. The major disadvantage of this design is that the external magnet limits the density at which relays may be spaced and still maintain independent switching characteristics. As a result, the relays are produced serially rather than in a batch process, thereby decreasing the efficiency of production.

A heretofore, unaddressed need exists in the industry for providing a system and method for switching current with a micromachined magnetically-driven relay where the driving magnet is not external to the system.

SUMMARY OF THE INVENTION

The present invention overcomes the inadequacies and insufficiencies of the prior art as discussed hereinbefore. The present invention provides for a magnetic relay system and method capable of microfabrication production with an internal driving magnet. By combining the advantages of a micromachined device with the advantage of a magnetically-driven relay, the optimum performance for relays in particular applications are realized.

The magnetic relay system and method of the present invention comprises an electromagnet, a movable plate, and a conductive contact. In the preferred embodiment, the electromagnet is a magnetic core with at least one conductive coil winding through the core in a meander nature such that an electromagnetic flux is produced when current is passed through the coil. A portion of the movable plate is comprised of a magnetic material so that the plate's position is affected by the presence of a magnetic flux, and the movable plate is positioned within the effects of the electromagnetic flux generated by the electromagnet such that the movable plate is capable of movement due to the electromagnetic flux when such flux exists. At least one conductive contact is positioned within the path of the movement of the movable plate. The contact is configured such that the movable plate is engaged with the contact when current is to be flowing through the relay system and into an electrical system connected to the contact.

In accordance with another feature of the present invention, the relay system and method may include a permanent magnet to control the placement of the magnetic conductive plate. The permanent magnet could counteract the force generated by the electromagnetic flux such that the relay switches state (i.e., the movable plate either engages or disengages the conductive contact) when the electromagnetic flux is removed or reduced. Alternatively, the permanent magnet could reinforce the electromagnetic flux such that the relay remains in the same state when the electromagnetic flux is removed or reduced. Accordingly, a bistable device is created that changes state when electromagnetic flux is applied to the system.

Another feature of the present invention is that the magnetic core, coil, and/or movable plate may be formed on a single substrate through a process, such as electroforming, photolithography, and/or screen or stencil printing. In this way, the electromagnet may be formed on a layer of the substrate, and the conductive contact may be coupled to the electromagnet layer. The movable plate may be formed on a sacrificial layer which is positioned on top of the electromagnet layer and contact. The sacrificial layer may then be removed leaving an air gap for the movement of the moveable plate. Accordingly, the entire relay system is formed on a single substrate, and the moveable plate is capable of engaging and disengaging the contact due to the electromagnetic flux of the electromagnet layer.

Another feature of the present invention is that the magnetic core and coil may be formed on one substrate while the movable plate may be formed on another substrate by a process such as electroforming, screen printing, or another suitable technique. In this way, substrates encompassing the electromagnets and substrates encompassing the movable plates may be batch fabricated separately, and then positioned and bonded as a group before being separated into individual relays or relay arrays.

Another feature of the present invention is that there may be additional contacts located on the side of the movable plate opposite of the first and second contacts. In this way, the movable plate engages the first and second contacts when the electromagnet pulls the movable plate in one direction, and the movable plate engages the additional contacts when the electromagnet pushes the movable plate in the opposite direction.

Another feature of the present invention is that each aforementioned contact may be replaced by a plurality of similar contacts isolated from each other by an insulator. Since each contact can be connected to a different electrical system or circuit, numerous electrical systems or circuits can be controlled by a single relay.

The magnetic relay system and method capable of microfabrication production of the present invention have many advantages, a few of which are delineated hereafter as examples.

An advantage of the magnetic relay system and method of the present invention is that they provide for a general scheme for batch manufacturing magnetically-driven relays. This allows for the production of a large number of relays at a relatively low cost, thereby, optimizing the efficiency of production.

Another advantage of the magnetic relay system and method of the present invention is that they provide a relay switch operating at a relatively low supply voltage. A low supply voltage is desirable and necessary in many particular applications.

Another advantage of the magnetic relay system and method of the present invention is that they provide a relay switch with a relatively fast switching speed.

Another advantage of the magnetic relay system and method of the present invention is that they facilitate construction of large arrays of relays.

Another advantage of the magnetic relay system and method of the present invention is that they provide a general scheme for micromachining relays and relay arrays on a single substrate. Accordingly, the production of relays and relay arrays is maximized since such manufacturing requires less production efficiency time and cost.

Another advantage of the magnetic relay system and method of the present invention is that they provide for a relay with a reduced thermal offset voltage. The smaller sized relay of the present invention will inherently allow for a smaller temperature gradient between contacts. This allows for more accurate devices to be used for measuring small voltage signals in applications such as an instrumentation amplifier.

Another advantage of the magnetic relay system and method of the present invention is that they provide for fabrication of a micromachined relay using, exclusively if desired, low cost packaging, techniques, including screen printing and/or electroforming.

Other features and advantages of the present invention will become apparent to one with skill in the art upon examination of the following drawings and detailed description. It is intended that all such additional features and advantages be included herein within the scope of the present invention, as is defined by the claims.

BRIEF DESCRIPTION OF THE DRAWINGS

The present invention can be better understood with reference to the following drawings. The elements of the drawings are not necessarily to scale, emphasis instead being placed upon clearly illustrating principles of the present invention. Furthermore, like reference numerals designate corresponding parts throughout the several views.

FIG. 11(*b*) is a top view of the sixth embodiment of the present invention;

FIG. 14(*b*) is a side view of the ninth embodiment of present invention;

DETAILED DESCRIPTION OF THE PREFERRED EMBODIMENT

Although not limited to this particular application, the magnetic relay system and method of the present invention are particularly suited for microfabrication and batch production. In the context of this document, "microfabrication techniques" mean any process or method for producing micromachined or micro-level structures, including, but not limited to, electroforming (e.g., electroplating, electrowinning, electrodeposition, etc.), packaging techniques (e.g., sputtering, evaporation, screen printing, etc.) for creating electrical components, a photolithography process and thick or thin film fabrication techniques. In accordance with the invention, the magnetic core and coils are formed on a substrate layer by a process, such as, but not limited to, electroforming, and the conductive contact is coupled to this layer. The movable plate is formed on a sacrificial layer that is formed on the combination of electromagnet and the contact. The sacrificial layer is then removed, and the air gap left by the sacrificial layer allows the movable plate to engage the contact.

Magnetic Relay System

Figure 1:
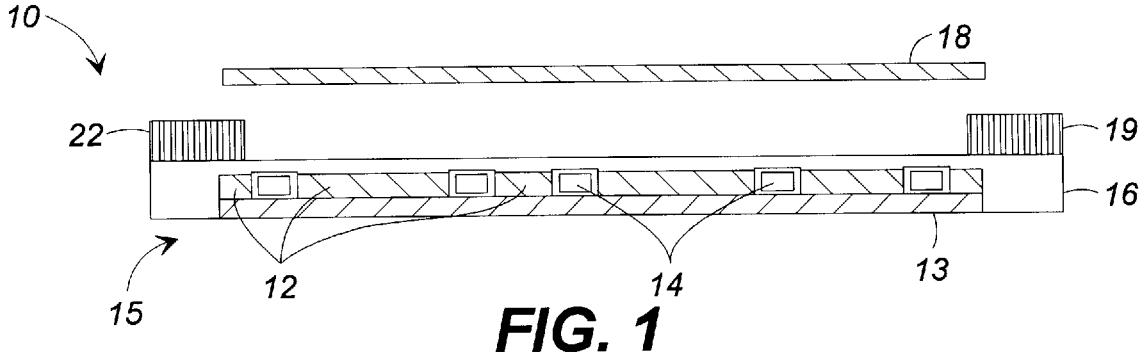
FIG. 1 is a cross-sectional view of the magnetic relay of the present invention.

A magnetic relay system 10 in accordance with the present invention is illustrated by way of a cut-away view in FIG. 1. Magnetic material, referred to as the magnetic core 12, is coupled to a base 13. The base 13 preferably comprises a magnetic material as well and is formed upon a substrate 23. Although non-magnetic materials are possible, providing magnetic material in the base 13 increases the efficiency of the force generated by the electromagnet 15 by concentrating the flux from the electromagnet 15 toward plate 18. At least one conductive coil 14 passes through grooves in the magnetic core 12 such that an electromagnetic flux is produced if current is passed through the coil 14. The magnetic core 12, base 13 (can also include magnetic material), and coil 14 essentially define the electromagnet 15.

The coil 14 is preferably within the same plane as the magnetic core 12 and is separated from the magnetic core 12 if the core 12 is comprised of conductive material. The preferred manner to accomplish separation is to encompass the coil 14 within an insulator 16 which is coupled to the magnetic core 12 as depicted in FIG. 1.

Figure 2:
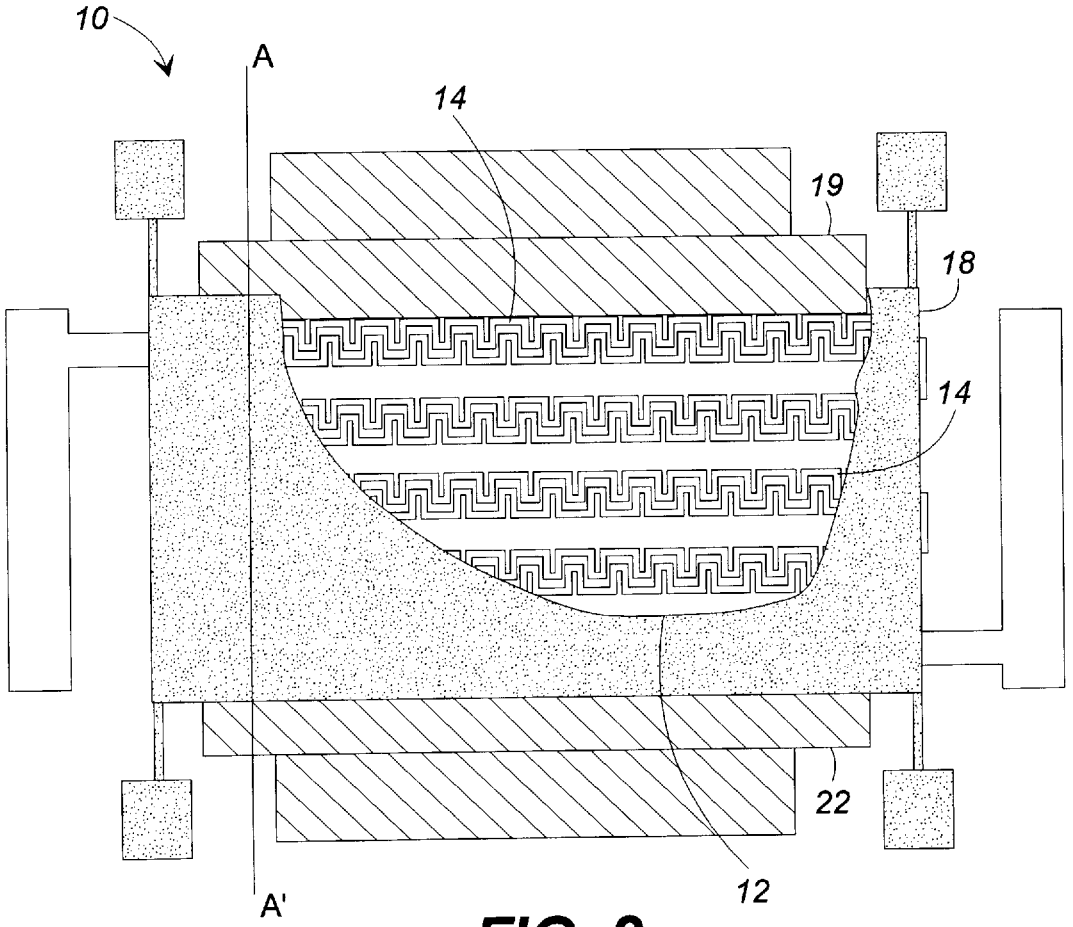
FIG. 2 is a top view of the preferred embodiment of the present invention.
Figure 3A:
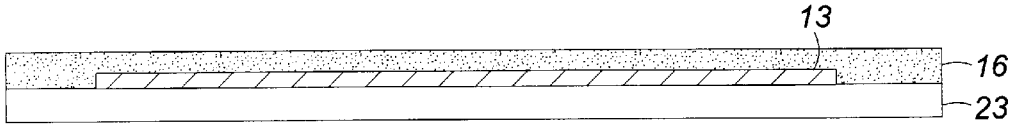
FIGS. 3(*a*)–3(*g*) are a step by step depiction of the microfabrication steps of the preferred embodiment.
Figure 3B:
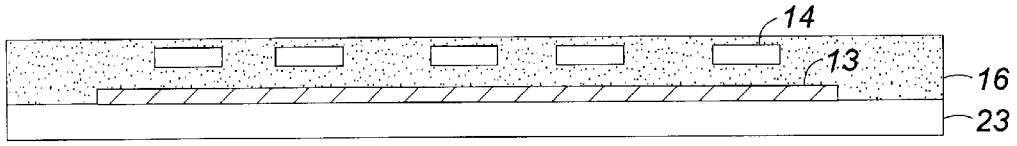
Figure 3C:
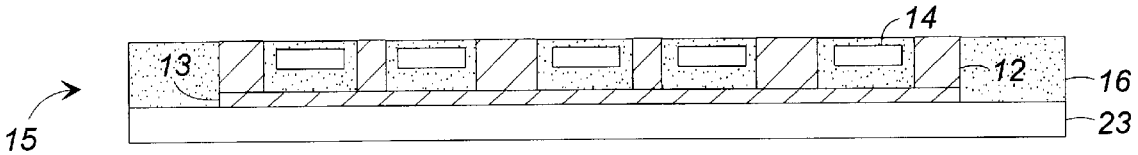
Figure 3D:
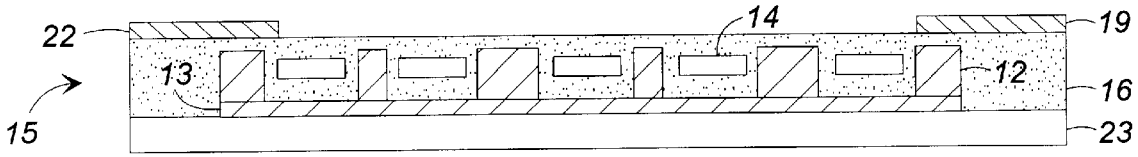
Figure 3E:
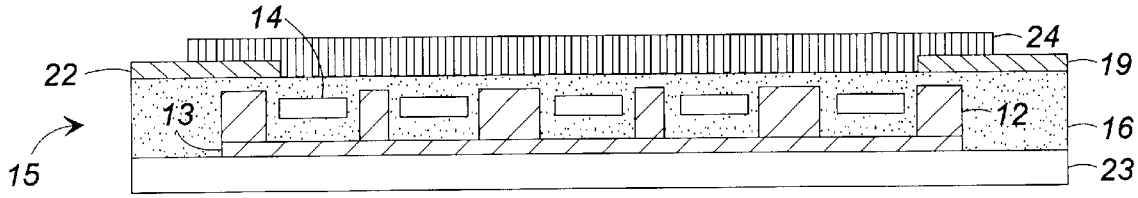
Figure 3F:
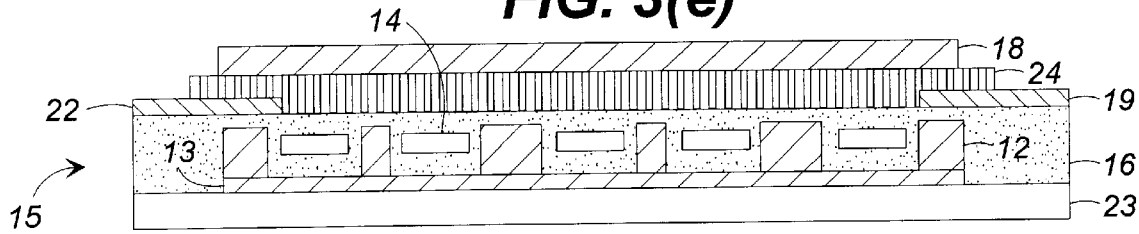
Figure 3G:
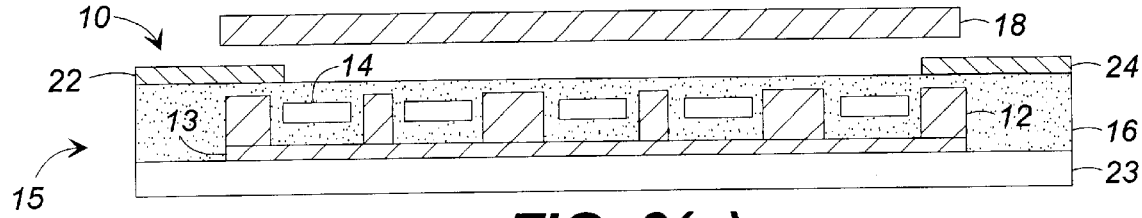

As can be seen by reference to FIG. 2, the conductive coil 14 winds through the magnetic core 12 in a meander nature. The actual pattern of the coil 14 can vary as long as the pattern generates an electromagnetic flux. It can be appreciated by one ordinarily skilled in the art that the electromagnetic flux produced in one portion of the magnetic core 12 can flow in a direction opposite to that of an electromagnetic flux produced in another portion of the magnetic core 12 (depending on the location of the two portions and the direction of the current flow in the coil 14). Under such conditions, the electromagnetic fluxes can cancel each other out such that no cumulative electromagnetic flux exists. Therefore, any pattern of the coil 14 winding through the magnetic core 12 is sufficient so long as the system 10 provides a sufficient electromagnetic flux when current is passed through the coil 14 to cause plate 18 to move.

Furthermore, having the entire length of the coil 14 encompassed on two sides by the magnetic core 12 and on a third side by the base 13 reduces reluctance. This helps to concentrate the electromagnetic flux generated by electromagnet 15 in a direction toward movable plate 18 helping to contain the electromagnetic flux within the system 10. This feature is not necessary for successful operation of the present invention but helps to increase the efficiency of the system 10. As a result of concentrating the electromagnetic flux toward plate 18, multiple systems 10 can be batch fabricated in a close proximity with one another without the electromagnetic flux from one system significantly affecting the other system.

A movable plate 18 (hereinafter referred to as "plate") is positioned above the magnetic core 12 and conductive coil 14. A portion of plate 18 is comprised of a magnetic material so that plate 18 is affected by the presence of a magnetic flux. The positioning of plate 18 can occur via any attaching means so long as the plate 18 is movable in a general direction to and from the magnetic core 12 and so long as plate 18 is positioned within the effects of the electromagnetic flux produced by the electromagnet 15 when a predetermined amount of current passes through the coil 14. In the preferred embodiment, the attaching means produces a sufficient force to hold plate 18 away from contacts 19 and 22 when there is no electromagnetic flux being generated by the electromagnet 15.

In the preferred embodiment, two conductive contacts 19 and 22 are rigidly positioned by another attaching means between plate 18 and the magnetic core 12. Also, in the preferred embodiment, plate 18 is positioned such that contacts 19 and 22 are not engaged with plate 18. Contacts 19 and 22 are connected to an electrical circuit outside of the system 10 of the present invention. The contacts 19 and 22 may be coupled to the magnetic core 12 if such core 12 is comprised of non-conducting material. Otherwise, the contacts 19 and 22 should be coupled to insulator 16 as depicted in FIG. 1.

As can be seen by reference to FIG. 1, contacts 19 and 22 are positioned such that when plate 18 moves due to the magnetic flux (i.e., down toward the magnetic core 12 in the preferred embodiment), plate 18 engages both contact 19 and contact 22. Contacts 19 and 22 stop the movement of plate 18, and the electromagnetic flux produced by the electromagnet 15 is sufficient to keep plate 18 engaged with contacts 19 and 22. Furthermore, a portion of plate 18 is comprised of conductive material such that when plate 18 is engaged to contacts 19 and 22, current is able to flow from one of the contacts 19 or 22, across plate 18, to the other contact. Therefore, the system controls whether current flows between the outside circuits connected to contacts 19 and 22 by controlling whether plate 18 engages contacts 19 and 22.

It should be noted that in the preferred embodiment of the present invention, the base 13, coil 14, insulator 16, and magnetic core 12 are formed on a substrate with a process such as, but not limited to, electroforming, photolithography, and/or screen or stencil printing. This process of forming the system 10 on a substrate is depicted in FIG. 3. First, base 13 is formed on a substrate 23 as shown in FIG. 3(*a*) via any suitable method, for example, electroforming or a packaging technique, such as screen printing. Conductive coil 14 is then formed above base 13 and within insulator 16 as shown in FIG. 3(*b*) via any suitable method, for example, electroforming or a packaging technique, such as screen printing. Magnetic core 12 is formed adjacent to conductive coil 14 and extends down to base 13 according to FIG. 3(*c*) via any suitable method, for example, electroforming or a packaging technique, such as screen printing. Contacts 19 and 22 are formed on insulator 16 as shown in FIG. 3(*d*) via any suitable method, for example, electroforming or a packaging technique, such as screen printing. A sacrificial layer 24 is then formed on the combination of the insulator 16 and contacts 19 and 22 according to FIG. 3(*e*) via any suitable method, for instance, electroforming or a photolithography method. Finally, plate 18 is formed on the sacrificial layer 24 as shown in FIG. 3(*f*), and the sacrificial layer 24 is then removed using a chemical etchant from the system 10 leaving an air gap between plate 18 and contacts 19 and 22 as depicted in FIG. 3(*g*). The resulting device is depicted FIG. 1 and realizes a magnetic relay capable of batch production with microfabrication techniques.

It should be further noted that comprising the substrate 23 of magnetic material helps to concentrate the magnetic flux generated by electromagnet 15 toward plate 18. Under such an arrangement, base 13 is not necessary to help increase the efficiency of the system 10 as previously discussed, and base 13 may be removed from the system 10.

It should be further noted that contacts 19 and 22 could be replaced by a plurality of contacts separated by an insulator. Each contact could be connected to a different electrical system, and the magnetic relay 10 could then control the connection of multiple systems.

Operation

No electromagnetic flux is produced when there is no current flowing through the coil 14. As a result, the attaching means for plate 18 holds plate 18 away from contacts 19 and 22 as depicted in FIG. 1. A change in the system 10 occurs where sufficient current is passed through the coil 14 in the appropriate direction to cause the electromagnet 15 to produce an electromagnetic flux which draws plate 18 toward the magnetic core 12. Plate 18 engages contacts 19 and 22 which prevent further movement of plate 18, and the electromagnetic flux keeps plate 18 engaged with contacts 19 and 22. As a result, current being conducted in contact 19

(from the outside electrical system connected to contact 19) passes through plate 18 and into contact 22 where the current is introduced to the outside electrical system connected to contact 22. This current continues to flow until a change causes current to stop flowing through coil 14 thereby removing the electromagnetic flux from the system 10. Without the magnetic flux, the force provided by the plate's 18 attaching means is sufficient to return plate 18 back to its original position before the electromagnetic flux existed. Accordingly, plate 18 disengages contacts 19 and 22 and returns to its original position, and, therefore, current stops flowing from contact 19 to contact 22. This cuts off the flow of current to the electrical system connected to contact 22, and, accordingly, the system 10 acts as a relay controlling whether current flows from one outside electrical system to another.

It could be appreciated by one ordinarily skilled in the art that the same effect could be obtained even though the current through coil 14 is not completely cut off. It is sufficient if the current is merely reduced to the point that the electromagnetic flux generated by the electromagnet 15 is incapable of overcoming the force of the attaching means. Once this point is reached, the plate 18 will disengage contacts 19 and 22 even though current may still be flowing through coil 14.

It could be appreciated by one ordinarily skilled in the art that a normally closed relay could be obtained if the attaching means held plate 18 engaged with contacts 19 and 22. Current would then flow to the electrical system connected to contact 22 until electrical current is passed through the coil 14 in the opposite direction as disclosed above. The electromagnetic flux produced by the electromagnet 15 would then push plate 18 away from contacts 19 and 22 removing the connection between contacts 19 and 22. Therefore, current would be cut off from the electrical system connected to contact 22 only when electric current is applied to the coil 14. One ordinarily skilled in the art could appreciate the fact that permanent magnetic material should be included within the system 10 (either in the magnetic core 12, base 13, substrate 23, and/or plate 18) to enable plate 18 to be affected by the electromagnetic flux produced within the system 10.

Alternatively, plate 18 could be positioned underneath contacts 19 and 22 with the attaching means holding plate 18 against contacts 19 and 22. Then, when an electrical current is passed through coil 14, an electromagnetic flux is produced by the electromagnet 15. This electromagnetic flux then acts to pull plate 18 toward the electromagnet 15, thereby causing the electrical connection between contacts 19 and 22 to be broken. When the electrical current in coil 14 is reduced to a sufficient predetermined level, then the electromagnetic flux produced by electromagnet 15 is insufficient to pull plate 18 away from contacts 19 and 22, as the force provided by the attaching means of plate 18 is sufficient to return plate 18 to its original position. Thus, plate 18 again connects contacts 19 and 22 and allows an electrical current to flow between contacts 19 and 22.

It can be further appreciated by one ordinarily skilled in the art that one contact 19 or 22 is not necessary. By attaching an outside electrical system directly to plate 18 rather than to one of the contacts 19 or 22, plate 18 itself acts as one of the contacts. Therefore, the system 10 is still operable if one of the contacts 19 or 22 is removed.

Second Embodiment

Figure 4:
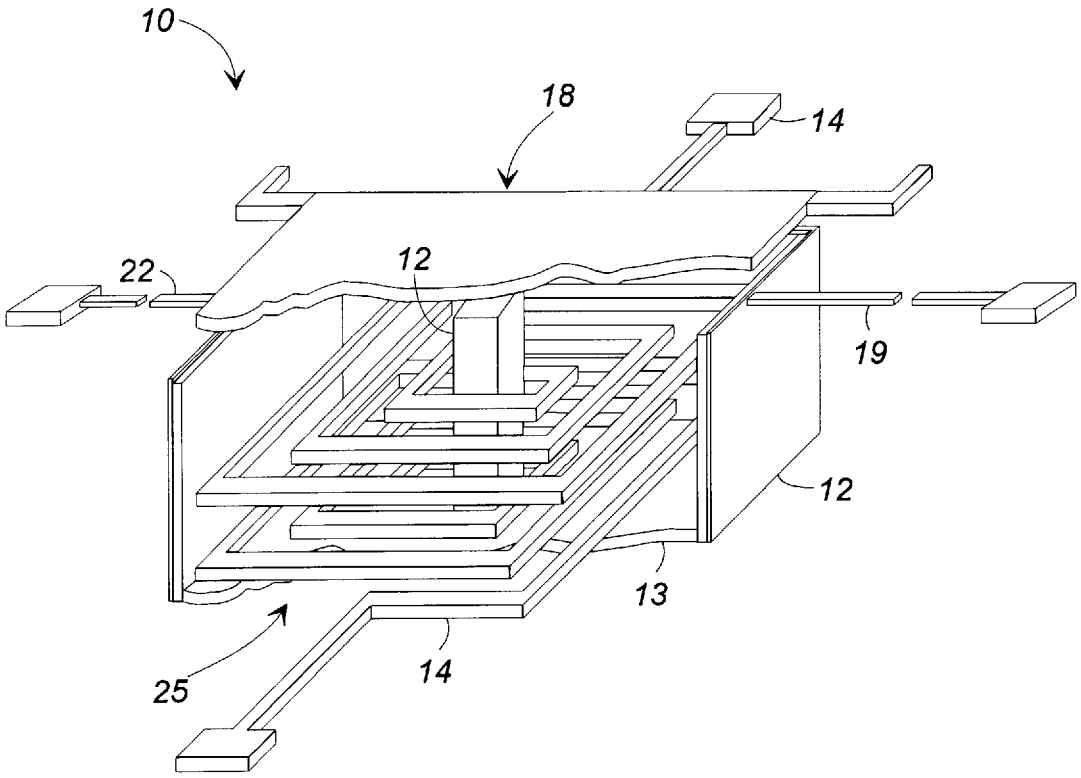
FIG. 4 is a cut-away view of the second embodiment of the present invention.
Figure 5:
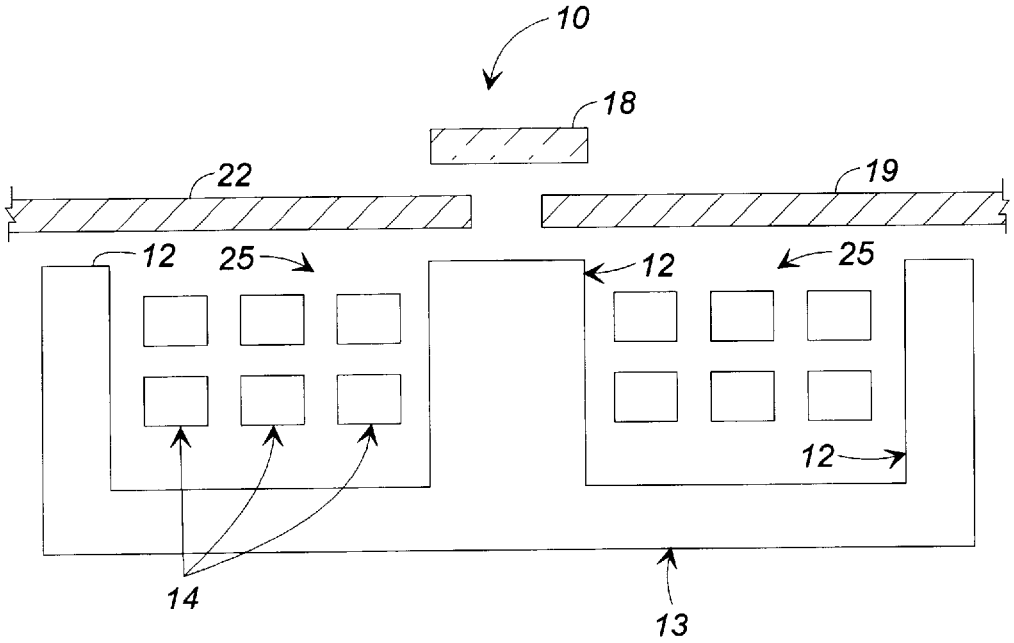
FIG. 5 is a cross-sectional view of the second embodiment of the present invention.

A second embodiment of the magnetic relay system 10 of FIG. 1 is depicted in FIG. 4. This embodiment operates the same way as the preferred embodiment except that the electromagnet 15 of the preferred embodiment is replaced by a planar spiral electromagnet 25 which is well known in the industry. See FIG. 4. As can be seen in FIG. 5, magnetic core 12 exists in the center of the relay and on the sides of the relay. At least one conductive coil 14 is spiraled around the magnetic core 12 in the center of the relay. By passing current through the coil 14, an electromagnetic flux is produced in the same manner as the preferred embodiment. Accordingly, the only difference in this embodiment and the preferred embodiment is the arrangement of the magnetic core 12 and coil 14 producing the electromagnetic flux.

Micromachining the electromagnet 25 of this embodiment is not as simple as the preferred embodiment. Unlike the single layer coil 14 fabricated in the preferred embodiment, the manufacturing of coil 14 of the planar spiral electromagnet typically requires extra layering steps. For example, the coil 14 can be contained in multiple layers with vias connecting the different layers of coil 14 together. It can be appreciated by one ordinarily skilled in the art that the single layer design of the preferred embodiment is easier to micromachine.

Figure 6:
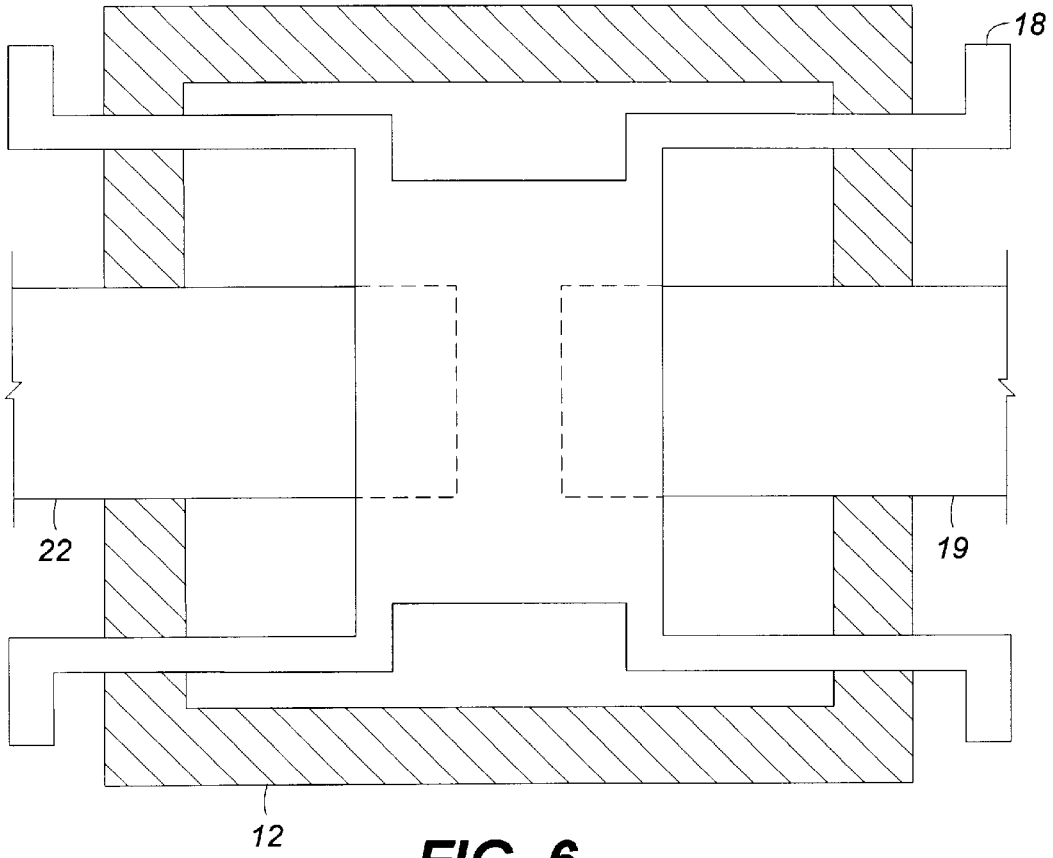
FIG. 6 is a top view of FIG. 4 with the magnetic core and coils removed.

It should be noted in comparing FIG. 4 to FIG. 5 that the dimensions of plate 18 (whether in the preferred embodiment or any subsequent embodiment) may or may not match that of the base 13. As shown by FIG. 5, any length of plate 18 is suitable so long as plate 18 engages both contact 19 and contact 22 when plate 18 is drawn toward the magnetic core 12 by the electromagnetic flux of the electromagnet 15 or 25. A top view of the magnetic relay system 10 having a plate 18 with a smaller length and width than the base 16 is shown in FIG. 6 for clarity.

Figure 7:
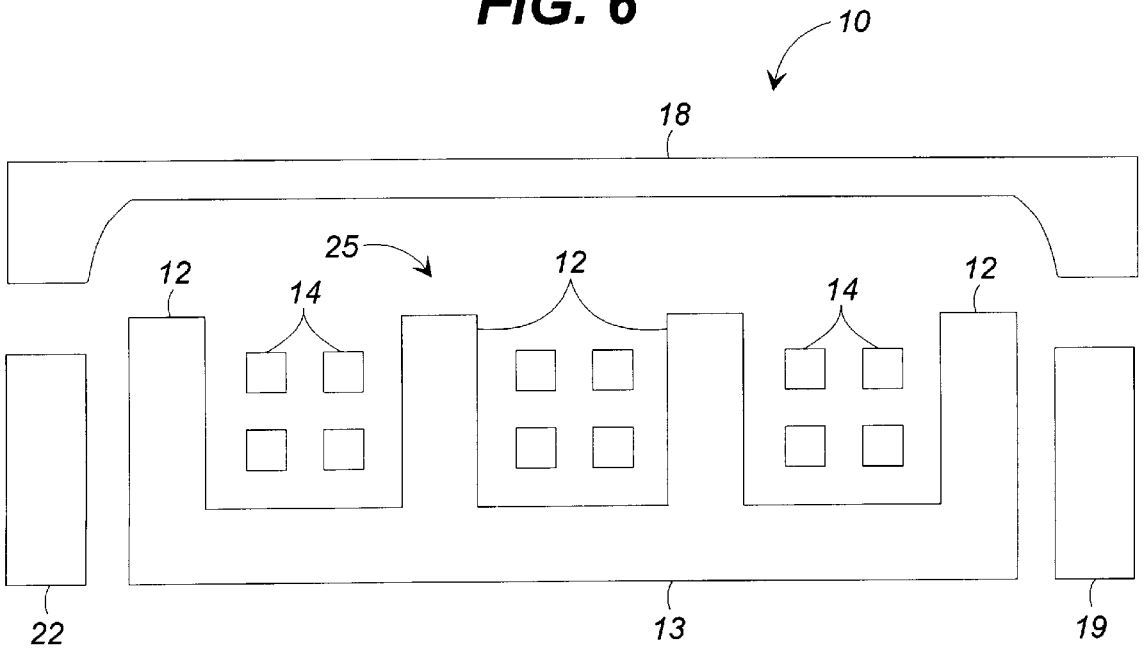
FIG. 7 is a cross-sectional view of the present invention with multiple magnetic cores and with contacts located outside of the perimeter of the base.

It should be further noted that any location of contacts 19 and 22 in any embodiment of the present invention is sufficient so long as the contacts 19 and 22 are engaged by plate 18 when plate 18 moves due to the electromagnetic flux produced by the electromagnet 15 or 25. FIG. 7 shows an example of a system 10 where the contacts are located outside of the base 16 but still capable of engaging plate 18. FIG. 7 also shows the concept that more than one set of coils may be used to generate a sufficient electromagnetic flux and that protrusions may extend outwardly from plate 18 to facilitate contact with contacts 19 and 22. Likewise, contacts 19 and 22 could contain upward protrusions to engage plate 18.

Third Embodiment

Figure 8:
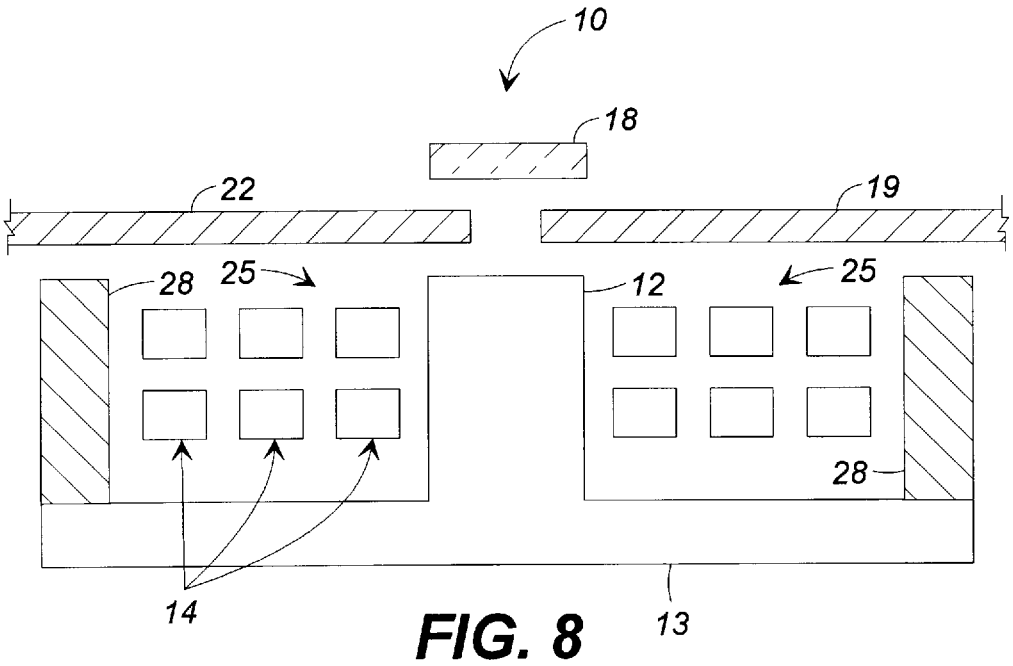
FIG. 8 is a cross-sectional view of the third embodiment of the present invention.

A third embodiment of the magnetic relay system 10 of FIG. 1 is where a portion of the magnetic core 12, base 13 or plate 18 is replaced by a permanent magnet 28. FIG. 8 illustrates such a system where a portion of the magnetic core 12 is comprised of permanent magnetic material. For purposes of illustration, FIG. 8 utilizes a planar spiral magnet, but any embodiment of the present invention may contain permanent magnetic material as disclosed herein below.

The force generated by the permanent magnet 28 is insufficient to cause plate 18 to move. However, when the electromagnetic flux from the electromagnet 15 or 25 brings plate 18 into contact with contacts 19 and 22, the magnetic flux generated by the permanent magnet 28 is sufficient to keep plate 18 engaged with contacts 19 and 22 since the distance between the permanent magnet 28 and plate 18 is decreased (and the effect of the permanent magnet to plate 18 is increased). At this point, the current through the coil 14 could be cut off or reduced since the permanent magnet 28 is now capable of holding plate 18 to contacts 19 and 22.

By applying sufficient current in the opposite direction of the coil 14, the electromagnetic flux overcomes the permanent magnetic flux holding plate 18 to contacts 19 and 22, and plate 18 returns to its original position disengaged from contacts 19 and 22. The force from the attaching means is now capable of holding plate 18 against the magnetic flux of the permanent magnet 28 since the distance therebetween has been increased.

One of ordinary skill in the art can appreciate the fact that the permanent magnet 28 can be replaced by an additional electromagnet so long as the current provided to the additional electromagnet is independent of the current in the electromagnet of the preferred embodiment.

Fourth Embodiment

Figure 9:
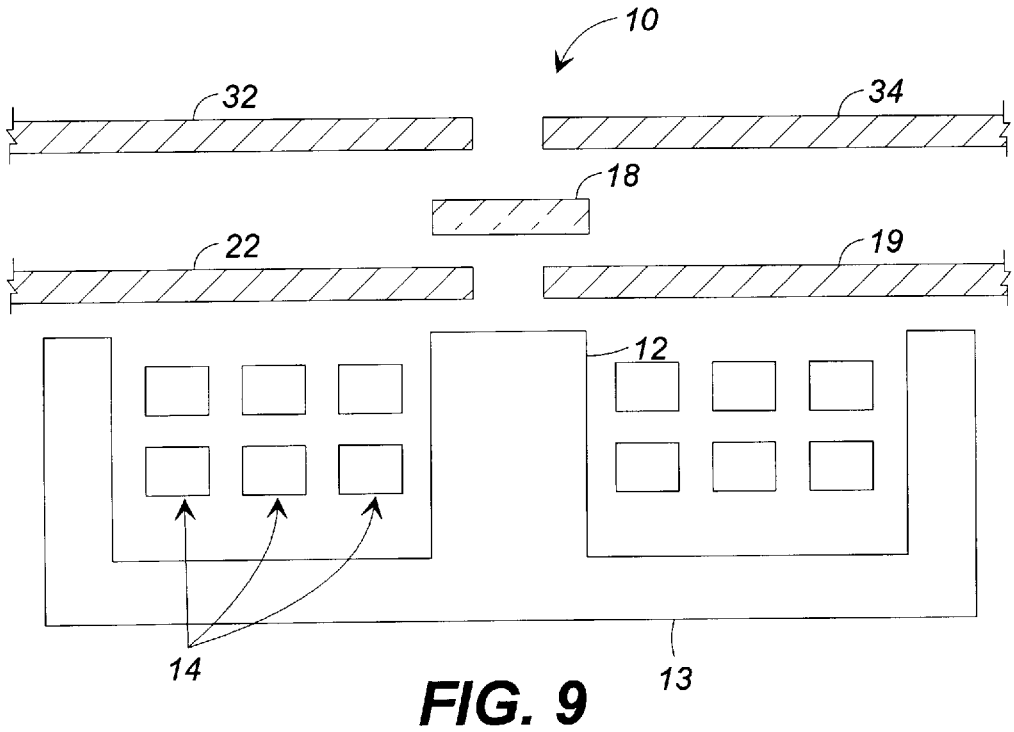
FIG. 9 is a cross-sectional view of the fourth embodiment of the present invention.

A fourth embodiment of the magnetic relay system 10 is illustrated in FIG. 9. Although FIG. 9 depicts a planar spiral electromagnet, the features of the fourth embodiment may be used in conjunction with any embodiment of the present invention.

Conductive contacts 32 and 34 have been added in conjunction with contacts 19 and 22. Therefore, if sufficient current is passed through the coils 14 (opposite to the current needed to engage plate 18, if comprised in part by a permanent magnetic material, with contacts 19 and 22), then plate 18 will engage contacts 32 and 34 passing current therebetween. The system 10 thereby potentially operates as a relay between two different pairs of electrical systems.

It should also be obvious to one of ordinary skill in the art that plate 18 may comprise a magnetic material, not necessarily a permanent magnet, if the attaching means of plate 18 holds plate 18 against contacts 32 and 34. Thus a form "C" relay may be realized. That is, a relay with a set of normally closed contacts (i.e., contacts 32 and 34) and a set of normally open contacts (i.e., contacts 19 and 22).

It should be obvious to one ordinarily skilled in the art that the system 10 can still operate as a magnetic relay if contacts 19 and 22 are removed leaving contacts 32 and 34 as the sole contacts.

Figure 10A:
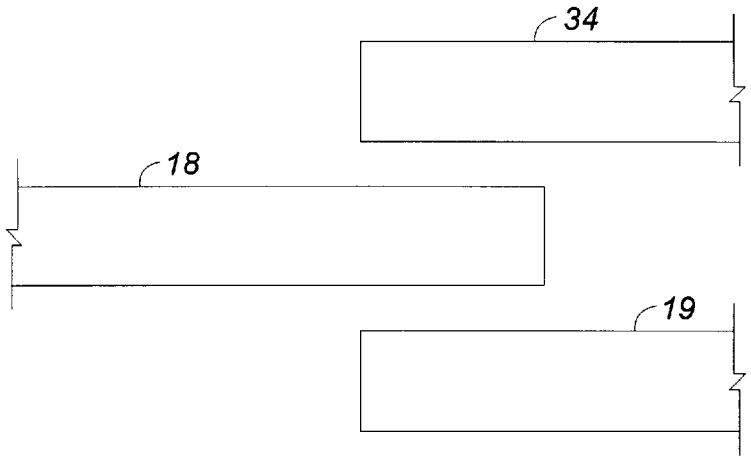
FIGS. 10(*a*)–10(*c*) are side views of the movable plate and contacts when the movable plate acts as a contact.
Figure 10B:
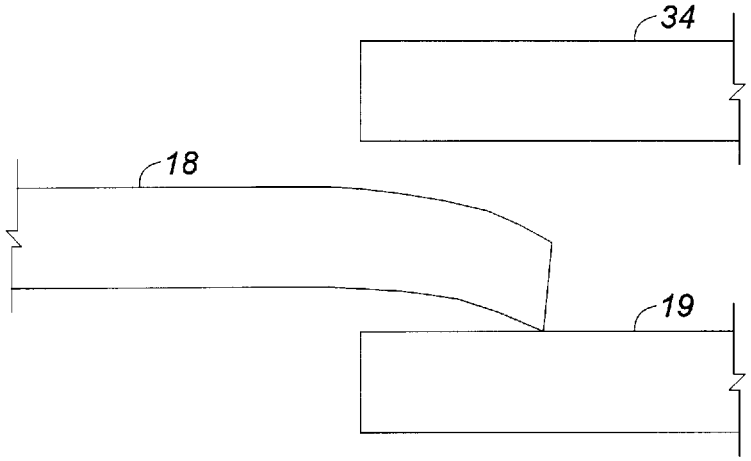
Figure 10C:
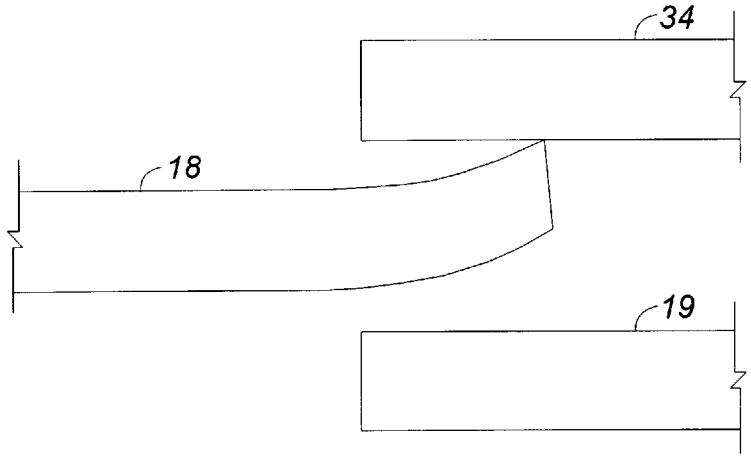

It should be noted that contacts 32 and 22 may be removed if plate 18 acts as its own contact by being connected to an outside electrical system. Accordingly, sufficient current through the coil 14 would create an electromagnetic flux to engage plate 18 to contact 19, and sufficient current through the coil 14 in the opposite direction would create an electromagnetic flux to engage plate 18 to contact 34. Fig. 10 illustrates this process by showing the different states of plate 18 in relation to contacts 19 and 34 when contacts 22 and 32 are removed. FIG. 10(*a*) shows plate 18 disengaged from contacts 19 and 34 when no electromagnetic flux exists. FIG. 10(*b*) shows plate 18 engaged with contact 19 when the electromagnetic flux is sufficient to move (via deformation) plate 18 toward contact 19. FIG. 10(*c*) shows plate 18 engaged with contact 34 when the electromagnetic flux is in the opposite direction.

Fifth Embodiment

A fifth embodiment of the magnetic relay system 10 is realized if the coil 14 is removed from the system 10 in FIG. 1, and the magnetic core 12, base 13 and/or plate 18 is replaced with permanent magnetic material. In this embodiment, the magnetic flux produced by the permanent magnetic material in magnetic core 12, base 13 and/or plate 18 keeps plate 18 continuously engaged with contacts 19 and 22 unless a sufficient outside mechanical force is created to disengage plate 18 from contacts 19 and 22. An example using such an actuation principle could be a device in which a permanent magnet is located in one section of a folding device and plate 18 is located in another section. By unfolding the device, plate 18 is separated from contacts 19 and 22. An example of such an application is a cellular phone that switches off when it is folded and switches on when it is unfolded.

It should be noted that the features of this embodiment are capable of being implemented in any other embodiment of the present invention.

Sixth Embodiment

Figure 11A:
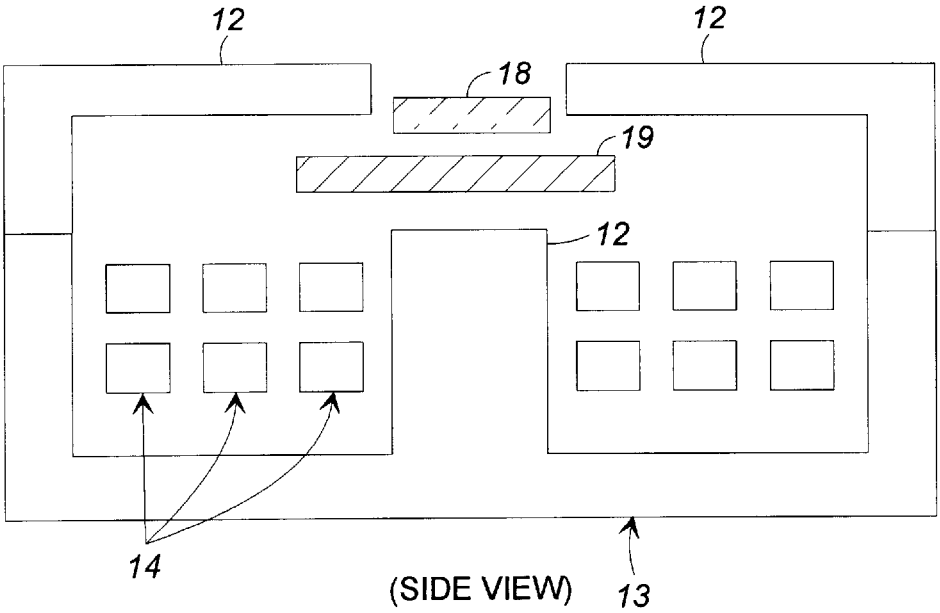
FIG. 11(*a*) is a side cross-sectional view of the sixth embodiment of the present invention.
Figure 11B:
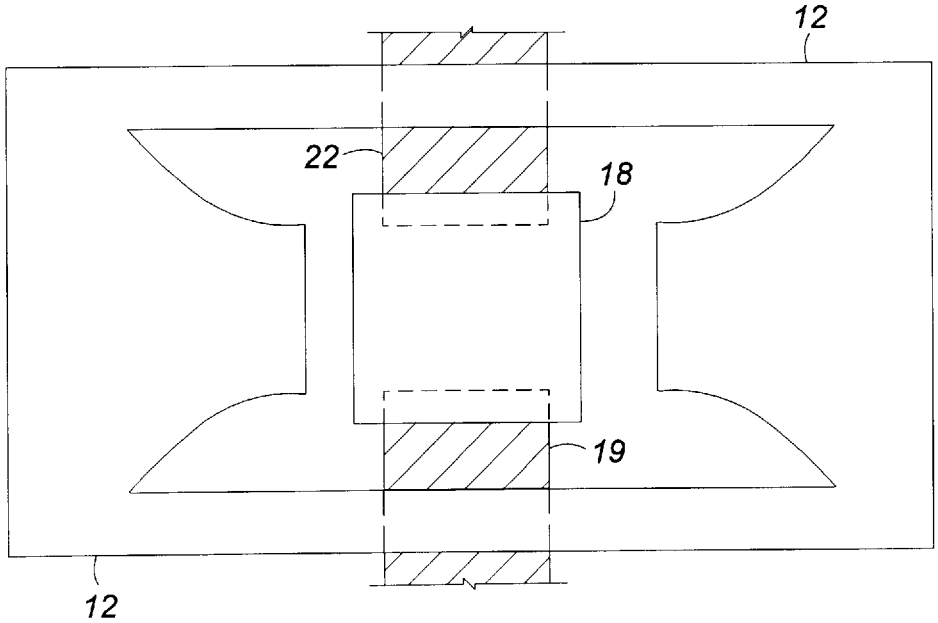

FIG. 11 shows another embodiment of the present invention. Although FIG. 11 depicts a planar spiral magnet for illustrative purposes, the features of this embodiment may be implemented in any other embodiment of the present invention. The magnetic core 12 has extended side cores which act to concentrate magnetic flux into an area parallel to the movement of the plate 18. A permanent magnetic material, located in the magnetic core 12 or other area below plate 18, holds plate 18 in contact with contacts 19 and 22. When electrical current passes through contact 19, contact 22, and plate 18 which exceeds a desired value, the Lorenz force causes a sufficient force to be generated on plate 18 to cause plate 18 to rise from contacts 19 and 22. Therefore, the flow from contact 19 to contact 22 is interrupted. When electrical current is passed through the coil 14, which provides sufficient electromagnetic flux to cause plate 18 to move down and engage contacts 19 and 22, current flow from contact 19 to contact 22 is once again reinstated.

Seventh Embodiment

Figure 12:
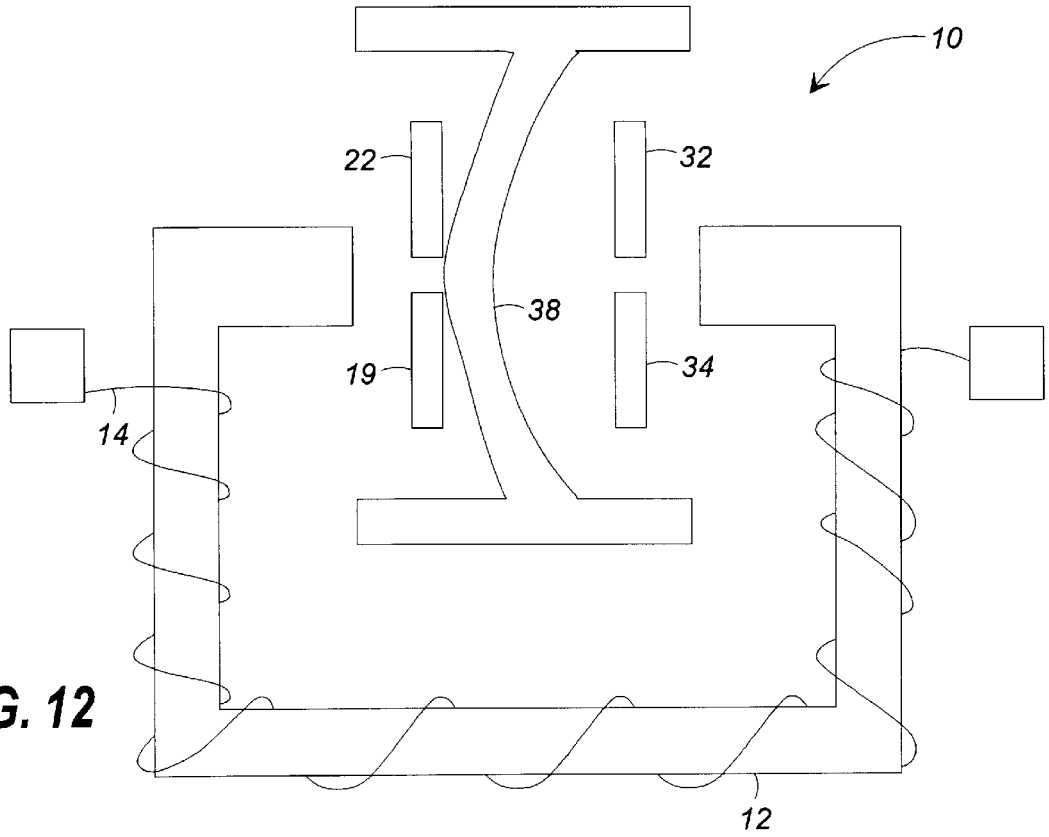
FIG. 12 is a drawing of the seventh embodiment of the present invention using a single coil.

FIG. 12 shows the use of a bistable beam 38 to perform the operation of the present invention. A bistable beam is a beam where a mechanical instability results from a process such as, but not limited to, residual stress induced buckling of the beam. Thus, the bistability is due to mechanical forces, and not magnetic forces. The beam 38 should have a magnetic material in it, preferably a permanent magnetic material, so that it will respond to an applied electromagnetic flux. When electrical current is applied to the coil 14, then the beam 38 moves to contacts 19 and 22 as shown in FIG. 10. The beam 38 remains there until current is applied in the opposite flow direction through the coil 14 where the beam 38 is then attracted to contacts 32 and 34. The beam 38 remains in contact with contacts 32 and 34 until current flow through the coil 14 is again reversed. Accordingly, the beam 38 switches which set of contacts that are engaged by the beam 38 depending on the flow of current through the coil 14.

Figure 13:
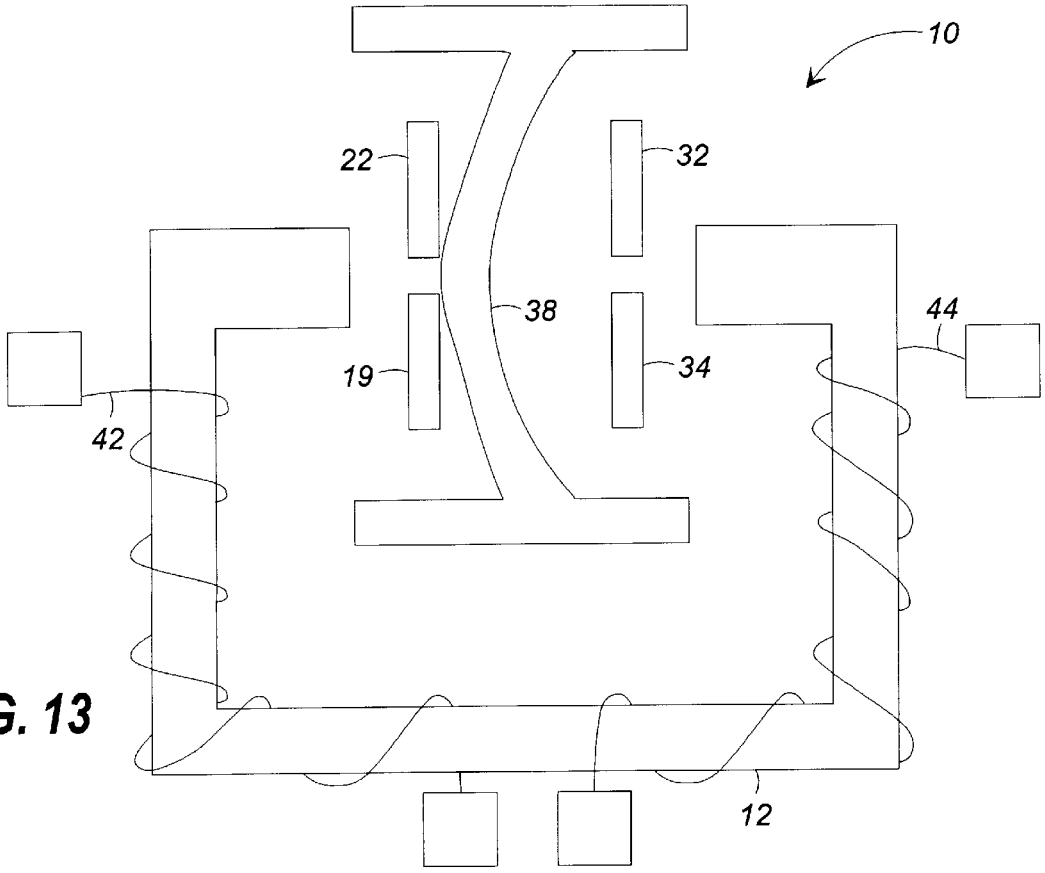
FIG. 13 is a drawing of the eighth embodiment of the present invention using multiple coils.

FIG. 13 shows the same configuration as FIG. 12 except that the single coil 14 is replaced by two coils 42 and 44. Each coil 42 and 44 can be controlled by different driving electrical circuits. The advantage of such a device is that it can be used to isolate two driving circuits for the same relay. Thus, two driving circuits can be used to control the switching action of the relay. Several configurations of this can be realized. If the electromagnetic flux generated by the two coils 42 and 44 is in the same direction, then the device can be designed to act as a logic element. Thus, if only one coil 42 or 44 is conducting current or if both coils 42 and 44 produce a flux that is in the same direction, then the beam 38 is attracted to a predetermined pair of contacts 19 and 22 or contacts 32 and 34 (depending on which direction the current is flowing). However, if the currents are both in opposite directions, then the relay would not change states. It would be evident to one skilled in the art that variations of the mechanical and magnetic properties of the beam 38 and coil 42 and 44 configurations could result in different logic functions being performed. The advantage of such a logic switch is that it can switch an electrical signal based on two, or more, inputs without requiring additional logic circuitry to drive the relay's function.

It should be noted that the bistable device of this embodiment may be implemented in any other embodiment of the present invention by replacing plate 18 with the bistable beam 38.

Eighth Embodiment

Instead of having a single plate 18 that is capable of engaging contacts 19 and 22, the magnetic relay system 10 of any of the other embodiments of the present invention can have a plurality of plates 18 of different sizes. As the current through the coil 14 is increased, the electromagnetic flux drawing the plates 18 is also increased. The plates 18 requiring a smaller actuation force begin to actuate and engage contacts 19 and 22 first. The resistance across contacts 19 and 22 decreases as more plates 18 engage contacts 19 and 22. Accordingly, higher levels of current through the coils 14 increase the electromagnetic flux and, hence, the number of plates 18 that engage the two contacts 19 and 22. On the other hand, lower levels of current passing through the coils 14 decrease the electromagnetic flux and, hence, the number of plates 18 that engage the two contacts 19 and 22. Accordingly, the resistance of the system 10 varies since the number of plates 18 connecting contacts 19 and 22 varies. The advantage of this embodiment is that resistance and, hence, amount of current flow across the relay system 10 can be controlled. This is especially useful in systems using high voltage signals in that the amount of voltage introduced to a system can be controlled by varying the resistance. In this way, the introduction of a large amount of current to a system within a short time interval can be prevented, thereby protecting the system.

This embodiment can also be used to convert analog signals into digital signals. It can be appreciated by one ordinarily skilled in the art that each plate 18 could be configured to represent a bit of a digital signal. Therefore, as the analog current generating the electromagnetic flux of the electromagnet increases, the plates 18 representing bits begin to actuate. The plate 18 requiring the smallest actuation force begins to actuate first and should, therefore, represent the least significant bit of the digital signal. The plate 18 that actuates next should represent the next significant bit until the most significant bit of the digital signal is reached. Therefore, as the analog current increases, more plates 18 actuate, thereby activating more bits of the digital signal. As the analog current decreases, more plates 18 disengage the contacts 19 and 22, thereby decreasing the number of activated bits on the digital signal. In this way, the eighth embodiment of the present invention could be used to convert an analog signal into a digital signal.

Ninth Embodiment

Figure 14A:
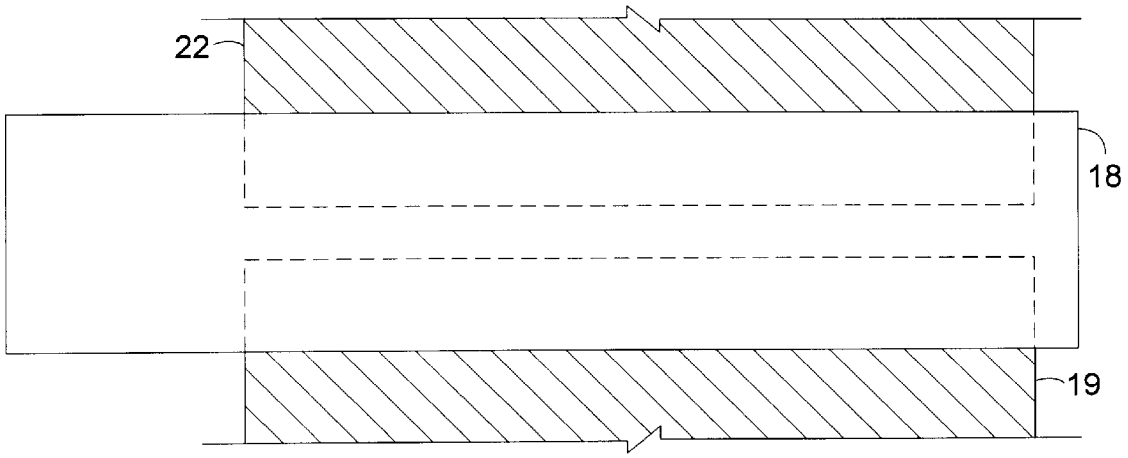
FIG. 14(*a*) is a top view of the ninth embodiment of the present invention.
Figure 14B:
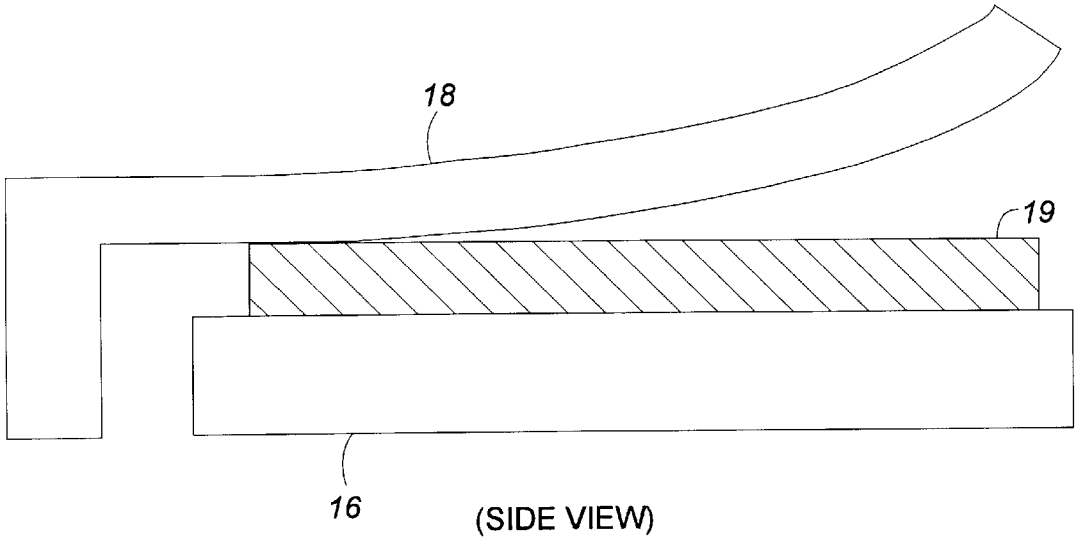

Another embodiment that varies the resistance of the system 10 is illustrated in FIG. 14. Plate 18 is mechanically deformed away from contacts 19 and 22. As the amount of current through the coils 14 is increased, the electromagnetic flux pulling on plate 18 is also increased. Plate 18 engages contacts 19 and 22 with the one end of plate 18 still deformed away from contacts 19 and 22. As the electromagnetic flux increases, more of plate 18 is drawn toward contacts 19 and 22 and, hence, a greater area of plate 18 engages contacts 19 and 22. Plate 18 continues to engage contacts 19 and 22 in a "zipper" like fashion until the entire relevant area of plate 18 is engaged with contacts 19 and 22. As more area of plate 18 engages contact 22, the resistance across the system 10 is decreased. On the other hand, as current through the coils 14 is decreased, more area of the plate disengages the contacts 19 and 22, and the resistance across the system 10 is increased. Accordingly, the resistance across the system 10 can be varied between a maximum and minimum value.

In concluding the detailed description, it should be noted that it will be obvious to those skilled in the art that many variations and modifications may be made to the preferred embodiment without substantially departing from the principles of the present invention. All such variations and modifications are intended to be included herein within the scope of the present invention, as set forth in the following claims. Further, in the claims hereafter, the corresponding structures, materials, acts, and equivalents of all means or step plus function elements are intended to include any structure, material or acts for performing the functions in combination with other claimed elements as specifically claimed.

Wherefore, the following is claimed:

1. A micromachined magnetic relay system comprising:

an electromagnet formed on a substrate, said electromagnet having a conductive coil;

a movable plate positioned within the effects of an electromagnetic flux produced by said electromagnet such that said movable plate moves along a path in a predetermined direction when said electromagnetic flux exists; and a conductive contact positioned within said path of movement of said movable plate, wherein said conductive coil is fully formed through microfabrication techniques.

2. The system of claim 1, wherein said electromagnet further comprises:

a magnetic core having a groove; and a conductive coil passing through said groove.

3. The system of claim 1, wherein said electromagnet further comprises;

a center magnetic core; and a conductive coil spiraling around said magnetic core.

4. The system of claim 1, wherein said predetermined direction is away from said electromagnet.

5. The system of claim 1, wherein said predetermined direction is toward said electromagnet.

6. The system of claim 1, wherein said movable plate is formed on a second substrate.

7. The system of claim 1, wherein said movable plate is formed on said substrate.

8. The system of claim 1, further comprising a permanent magnet positioned so that a permanent magnetic flux produced by said permanent magnet counteracts said electromagnetic flux produced by said electromagnet.

9. The system of claim 1, further comprising a permanent magnet positioned so that a permanent magnetic flux produced by said permanent magnet reinforces said magnetic flux produced by said electromagnet.

10. The system of claim 1, further comprising an attaching means configured to hold said magnetic plate in a predetermined position when said magnetic flux does not exist.

11. The system of claim 1, wherein said conductive contact comprises a plurality of conductive contacts separated by an insulator.

12. The system of claim 1, wherein said movable plate comprises a plurality of movable plates.

13. The system of claim 1, wherein said movable plate is mechanically deformed.

14. The system of claim 1, further comprising an insulator coupled to said magnetic core and said conductive contact.

15. The system of claim 1, wherein at least one of said electromagnet, said movable plate, or said conductive contact is formed via screen printing.

16. The system of claim 2, further comprising an insulator coupled to said magnetic core and said conductive coil.

17. The system of claim 3, further comprising a side magnetic core encircling said conductive coil on a side opposite that of said magnetic core.

18. A method for producing a micromachined magnetic relay, comprising the steps of:

forming an electromagnet;

generating an electromagnetic flux from said electromagnet;

positioning a movable plate within an effect of said electromagnetic flux;

varying said electromagnetic flux to an amount sufficient for moving said movable plate in a predetermined direction; and positioning a conductive contact within a path of movement of said movable plate, wherein said forming step includes the step of forming a conductive coil via microfabrication techniques and said generating step includes the step of passing electrical current through said conductive coil.

19. The method of claim 18, further comprising the step of forming said electromagnet on a first substrate.

20. The method of claim 18, further comprising the following steps:

coupling an insulator to said electromagnet; and coupling said conductive contact to said insulator.

21. The method of claim 18, further comprising the step of passing said conductive coil through a groove of magnetic material to form said electromagnet.

22. The method of claim 19, further comprising the step of forming said movable plate on a second substrate and bonding said first substrate to said second substrate.

23. The method of claim 18, further comprising the following steps:

forming a sacrificial layer on a substrate and connecting said sacrificial layer to said contact and said electromagnet;

forming said movable plate on said substrate and detachably connecting said movable plate to said sacrificial layer; and removing said sacrificial layer from said substrate.

24. The method of claim 19, wherein said substrate is comprised of magnetic material.

25. A fully integrated magnetic relay system, formed through microfabrication techniques, comprising:

an electromagnet for generating an electromagnetic flux;

a movable plate positioned within an effect of said electromagnetic flux; and a conductive contact positioned within a path of movement of said movable plate, whereby said movable plate moves along said path of movement in a direction toward said conductive contact and engages said conductive contact in response to a change in strength of said electromagnetic flux.

26. The system of claim 25, wherein said electromagnet further comprises:

a magnetic core having a groove; and a conductive coil passing through said groove.

27. The system of claim 25, wherein said electromagnet further comprises:

a magnetic core coupled to a base; and a conductive coil spiraling around said magnetic core.

28. The system of claim 25, wherein said bottom surface of said conductive contact is an insulator.

29. A magnetic relay system capable of production by microfabrication techniques, comprising:

a permanent magnet;

a movable plate detachably connected to a conductive contact; and a means for removing said movable plate from said conductive contact, said removing means including a fully integrated electromagnet configured to produce an electromagnetic flux for moving said movable plate.

30. The system of claim 1, wherein said electromagnet, said movable plate and said conductive contact are fully integrated with said microfabricated base.

31. The system of claim 1, wherein said conductive coil is formed through electroforming.

32. The system of claim 1, wherein said conductive coil is formed through photolithograhy.

33. The system of claim 1, wherein said conductive coil is formed through electronic packaging fabrication techniques.

34. The system of claim 1, wherein said conductive coil is planar.

35. The system of claim 1, wherein said magnetic relay system is fully integrated.

36. The system of claim 19, further including the step of forming said movable plate on said first substrate.

37. The system of claim 25, wherein said electromagnet includes a conductive coil fully formed through microfabrication techniques.

38. The system of claim 25, wherein a conductive coil associated with said electromagnet is planar.

* * * * *

UNITED STATES PATENT AND TRADEMARK OFFICE

CERTIFICATE OF CORRECTION

PATENT NO. : 5,847,631
DATED : December 8, 1998
INVENTOR(S) : Taylor, et al.

It is certified that error appears in the above-identified patent and that said Letters Patent is hereby corrected as shown below:

Delete Fig. 4 and replace with corrected Fig. 4.

3/9

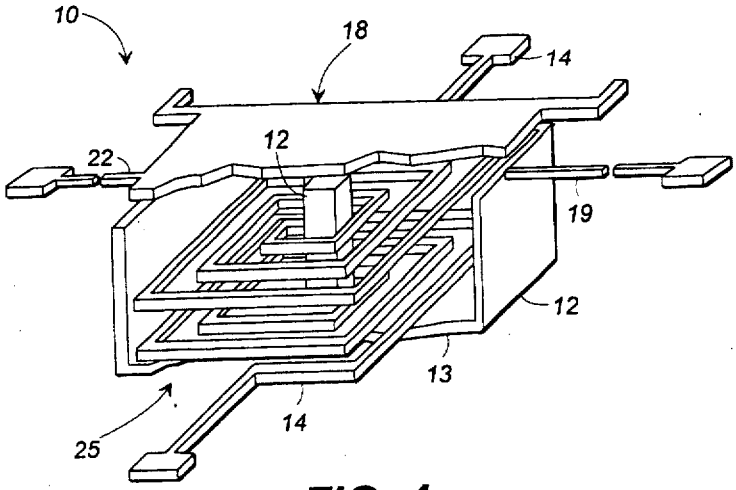

FIG. 4

Signed and Sealed this

Eighteenth Day of December, 2001

*Attest:*

*Attesting Officer*

JAMES E. ROGAN
*Director of the United States Patent and Trademark Office*